US009542843B2

(12) United States Patent
Stählin

(10) Patent No.: US 9,542,843 B2
(45) Date of Patent: Jan. 10, 2017

(54) PERSONALIZED UPDATING OF DIGITAL NAVIGATION MAPS

(75) Inventor: Ulrich Stählin, Eschborn (DE)

(73) Assignee: Continental Teves AG & Co. oHG (DE)

( * ) Notice: Subject to any disclaimer, the term of this patent is extended or adjusted under 35 U.S.C. 154(b) by 1186 days.

(21) Appl. No.: 12/675,015

(22) PCT Filed: Apr. 25, 2008

(86) PCT No.: PCT/EP2008/055062
§ 371 (c)(1),
(2), (4) Date: Jan. 14, 2011

(87) PCT Pub. No.: WO2009/030524
PCT Pub. Date: Mar. 12, 2009

(65) Prior Publication Data
US 2011/0102193 A1 May 5, 2011

(30) Foreign Application Priority Data
Aug. 29, 2007 (DE) ..... 10 2007 040 983

(51) Int. Cl.
*G08G 1/0967* (2006.01)
*G08G 1/01* (2006.01)

(52) U.S. Cl.
CPC .. *G08G 1/096716* (2013.01); *G08G 1/096741* (2013.01); *G08G 1/096791* (2013.01); *G08G 1/0104* (2013.01)

(58) Field of Classification Search
CPC ..... B60R 25/102; B60R 25/33; G08G 1/20; G08G 1/205; G08G 1/127
USPC ..... 340/500, 531, 539.1, 539.11–539.13
See application file for complete search history.

(56) References Cited

U.S. PATENT DOCUMENTS

| | | | | |
|---|---|---|---|---|
| 5,475,597 | A | 12/1995 | Buck | |
| 6,012,012 | A | 1/2000 | Fleck et al. | |
| 6,150,961 | A | 11/2000 | Alewine et al. | |
| 6,259,377 | B1 | 7/2001 | Noecker et al. | |
| 6,985,090 | B2 * | 1/2006 | Ebner | G08G 1/081 340/902 |
| 2002/0000920 | A1 * | 1/2002 | Kavner | G08G 1/0104 340/905 |
| 2002/0077742 | A1 * | 6/2002 | Mintz | G08G 1/01 701/117 |
| 2004/0015325 | A1 * | 1/2004 | Hirano et al. | 702/152 |
| 2004/0034464 | A1 * | 2/2004 | Yoshikawa et al. | 701/117 |
| 2004/0117113 | A1 | 6/2004 | Friedrichs et al. | |
| 2004/0148099 | A1 * | 7/2004 | Kim | G01C 21/26 701/423 |
| 2007/0005231 | A1 | 1/2007 | Seguchi | |

FOREIGN PATENT DOCUMENTS

| | | | |
|---|---|---|---|
| DE | 196 04 084 | A1 | 10/1996 |
| DE | 197 21 750 | A1 | 11/1998 |

(Continued)

*Primary Examiner* — James Yang
(74) *Attorney, Agent, or Firm* — RatnerPrestia

(57) ABSTRACT

A digital navigation map is updated by floating car data, wherein vehicles transmit their own position to a traffic control center, the traffic control center and/or at least one vehicle identifies a hazard situation, and an update for the digital navigation maps of the vehicles in the surroundings is initiated and performed.

16 Claims, 2 Drawing Sheets

(56) References Cited

FOREIGN PATENT DOCUMENTS

| | | | |
|---|---|---|---|
| DE | 197 25 556 | A1 | 12/1998 |
| DE | 199 09 276 | A1 | 9/2000 |
| DE | 100 63 588 | A1 | 7/2001 |
| DE | 101 05 449 | A1 | 8/2002 |
| EP | 1 439 373 | A2 | 7/2004 |

* cited by examiner

PERSONALIZED UPDATING OF DIGITAL NAVIGATION MAPS

CROSS REFERENCE TO RELATED APPLICATIONS

This application is the U.S. national phase of PCT International Application No. PCT/EP2008/055062, filed Apr. 25, 2008, which claims priority to German Patent Application No. 10 2007 040 983.6, filed Aug. 29, 2007, the contents of such applications being incorporated by reference herein.

FIELD OF THE INVENTION

The invention relates to the updating of digital maps for vehicles. In particular, the invention relates to an update device for a vehicle for updating a digital map, an update system for updating a digital map, the use of an update device in a vehicle, a method, a computer program product and a computer-readable medium.

BACKGROUND OF THE INVENTION

The rapid increase in vehicle traffic on the roads and the associated queues and travel time extensions are resulting in increased efforts worldwide to identify traffic states and to take them into account for the route selection or for route calculation in navigation systems.

If the geographical coordinates measured using a position-finding method are mapped directly to the coordinate system of a digital map, the true position of the object in the map may differ from the mapped position of the object in the map. The reason is firstly measurement errors in the position-finding method and secondly inaccuracies in the map. Since a navigation system needs to know the true position in the map, the map matching method aligns the measured position with the map information about the position and geometry of objects in the map, so that the most probable position of the object in the map is ascertained.

In vehicle navigation systems, the position of the vehicle is usually measured with the assistance of the satellite position-finding system GPS. The correctness of the measured and actual positions is specified at approximately 15 m in the case of GPS. Similarly, the digital map may have tolerances in the region of meters. For the navigation appliance, it is then necessary to ascertain the position of the vehicle in the digital map so that, by way of example, it is possible to determine a meaningful route calculation from the current location to the destination of travel. Without alignment of the measured position with the map information, the vehicle could find itself outside of the digitalized roads or on the wrong road in the map. Since the position of the vehicle in the digital map is critical for the navigation appliance, the measured position is aligned with the map information such that the most probable location of the vehicle in the map is ascertained for the navigation. In this regard, map matching involves utilizing the knowledge about the movements of the vehicle.

Vehicles are known which send what are known as floating car data (FCD). The system used for this comprises a GPS (Global Positioning System) receiver and a GSM (Global System for Mobile Communication) module. Both modules are already present in many vehicles even without FCD functionality. The GPS receiver measures the position, and the FCD methods use a large amount of these position data to ascertain travel times for the vehicle. The GSM network is used to transmit these travel times as a string of pearls to the traffic data control center. The latter can draw conclusions about the traffic situation from these travel times. In this way, traffic state data are collected for traffic information services.

There are already warnings about queues, for example through TMC, but these are usually not up-to-date enough and there is no information about the position of the end of the queue.

Ends of queues on highways are a major accident blackspot. If, additionally, the end of the queue is difficult to identify or can only be identified very late, the risk of a serious accident is very high. There is therefore a recurrent search for methods of warning the driver about these ends of queues at an early stage.

SUMMARY OF THE INVENTION

It is an object of the invention to provide an improved update for a digital map for a vehicle.

The invention specifies an update device for a vehicle for updating a digital map for the purpose of providing a queue warning, an update system, a use, a method, a computer program product and also a computer-readable medium.

The exemplary embodiments described relate in equal measure to the update device, the update system, the use, the method, the computer program product and the computer-readable medium.

In line with one exemplary embodiment of the invention, an update device for a vehicle for updating a digital map for the purpose of providing a queue warning is specified, wherein the update device has a detection unit for ascertaining a position for the vehicle, a communication unit for transmitting the position of the vehicle to a control center or to a second vehicle, and a control unit for updating the digital map. The updating of the digital map then allows a queue warning.

In other words, the queue warning is effected by virtue of a digital map which can be updated by radio in the vehicle. This update mechanism is used to transmit the existence of queues and the position of the end of the queue to the digital map, so that a warning can be given to the driver. This warning can be given either graphically or audibly.

The updating of the digital map, which may be a digital navigation map, also allows attention to be drawn to other hazards.

The use of the update mechanism for the digital map makes it possible to ensure that said map is always up-to-date. Floating car data transmit the position of the end of the queue in real time and make it available to the map, which allows rapid and effective warning of the drivers.

The communication unit, the unit for ascertaining the position of the vehicle and the control unit are subsequently also referred to as floating car modules.

At this juncture, it should be pointed out that GPS, within the context of the present invention, is representative of all Global Navigation Satellite Systems (GNSSs), such as GPS, Galileo, GLONASS (Russia), Compass (China), IRNSS (India), etc.

The term "digital maps" is also intended to be understood to mean maps for advanced driver assistance systems (ADASs), without any navigation taking place.

By way of example, the vehicle is a motor vehicle, such as a car, bus or heavy goods vehicle, or else a rail vehicle, a ship, an aircraft, such as a helicopter or airplane, or, by way of example, a bicycle.

The wireless transmission or the wireless reception of the update data takes place using GSM, UMTS, WLAN (e.g.

802.11p) or else using WiMax, for example. It is also possible to use other transmission protocols. Said protocols afford the advantage of standardization already having taken place.

In line with a further exemplary embodiment of the invention, the communication unit is designed to receive update data from the control center or from a third vehicle, wherein the update data are based on an ascertained position for the end of the queue. In this case, the digital map is updated on the basis of the received update data.

Each vehicle is thus equipped with a floating car data module. The vehicles have an appropriate sensor system which can be used to ascertain the vehicle positions. These positions are then sent to the control center, which then performs an analysis and ascertains where the end of the queue is currently situated (if a queue has arisen). The control center may be a static control center with an appropriate server, or else may also be a mobile control center in the broader sense. By way of example, the position of the end of the queue can also be ascertained by a computation unit in one of the vehicles.

In line with a further exemplary embodiment of the invention, the control center or the computation unit is designed to ascertain the position of the end of the queue on the basis of floating car data.

In line with a further exemplary embodiment of the invention, the computation unit or the control center is designed to ascertain the position of the end of the queue on the basis of a position of the last vehicle at the end of the queue.

In line with a further exemplary embodiment of the invention, the position at the end of the queue is ascertained in real time. In this way, it is possible to ensure that the digital maps in the vehicles are as up-to-date as possible.

In line with a further exemplary embodiment of the invention, the update device in the vehicle is designed to ascertain the position of the end of the queue.

In other words, the end of the queue can thus be ascertained not only by the control center or another external computation unit (in another vehicle) but also in the driver's own vehicle. For this, the vehicle may have various sensors. It is also possible for the ascertainment of the end of the queue to be based solely on the position measurements of the vehicle and the position measurements of other, adjacent vehicles.

In line with a further exemplary embodiment of the invention, an update system for updating a digital map in a vehicle for the purpose of providing a queue warning is specified, wherein the update system has an update device as described above and also a control center for creating the update data for the digital map on the basis of the transmitted position of the vehicle.

At this juncture, it should be pointed out that, if necessary, the control center can resort to a multiplicity of vehicle positions transmitted to it in order to ascertain the update data. In a given case, however, a single vehicle position may already be sufficient to identify an end of a queue. If appropriate, the vehicle also transmits further information together with its position, which information is based on measurements by the vehicle sensor system and may already have been analyzed or pre-evaluated within the vehicle.

This makes it possible to simplify the identification of an end of a queue.

In line with a further exemplary embodiment of the invention, the control center is designed to ascertain the position of the end of the queue. On the one hand, the position of the end of the queue may thus ensue within the vehicle. On the other hand, the end of the queue can also be ascertained in the control center.

In line with a further exemplary embodiment of the invention, the control center is designed to trigger an update for the digital map. When it has identified an end of a queue, the control center can thus send a warning to the vehicles by virtue of the updating of the digital maps being triggered by the update mechanism and not being controlled solely by the digital maps. An example of such an update mechanism is TMC.

In line with a further exemplary embodiment of the invention, the control center is designed to transmit the update data to selected vehicles.

By way of example, the control center always knows at what location each vehicle is situated, because the vehicles send their position statements to the control center, of course. When an end of a queue is identified at a particular location, the control center can send the update data with the queue warning just to the vehicles which are directly affected by the queue. In other words, the server itself can decide who needs to receive the information. In addition, the update device in the vehicle can also decide whether it would like to use this information to update the digital map.

In line with a further exemplary embodiment of the invention, the update system is designed to predict a queue on the basis of the transmitted position of the vehicle and transmitted positions from other vehicles.

In this way, it is possible to predict (forecast) the position of the end of the queue.

In line with a further exemplary embodiment of the invention, the use of an update device as described above in a vehicle is specified.

In line with a further exemplary embodiment of the invention, a method for updating a digital map for a vehicle for the purpose of providing a queue warning is specified, wherein the method involves a position for the vehicle being ascertained, the position of the vehicle being transmitted to a control center or to a second vehicle, update data for the digital map being created on the basis of the transmitted position of the vehicle, the update data being transmitted to the vehicle, and the digital map being updated by a floating car data module, which provides a queue warning.

In line with a further exemplary embodiment of the invention, a computer program product is specified which, when executed on a processor, instructs the processor to perform the following steps: ascertainment of a position for the vehicle, transmission of the position of the vehicle to a control center or to a second vehicle, reception of update data which are created on the basis of the transmitted position, and updating of the digital map by a control unit, which provides a queue warning.

In line with a further exemplary embodiment of the invention, a computer-readable medium is specified which stores a computer program product which, when executed on a processor, instructs the processor to perform the steps described above.

BRIEF DESCRIPTION OF THE DRAWINGS

The invention is best understood from the following detailed description when read in connection with the accompanying drawings. Included in the drawings is the following figures.

DETAILED DESCRIPTION OF THE PREFERRED EMBODIMENTS

Figure 1:
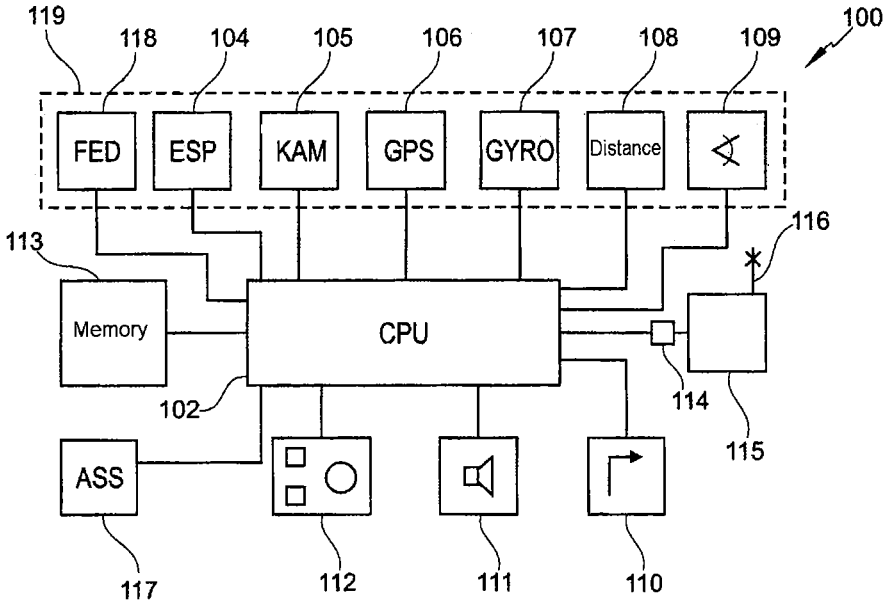
FIG. 1 shows a schematic illustration of an update device based on an exemplary embodiment of the invention.

The illustrations in the figures are schematic and not to scale.

In the description of the figures which follows, the same reference numerals are used for the same or similar elements.

FIG. 1 shows a schematic illustration of components of an update device 100 which is installed in a vehicle and which is used to update a digital map for queue warning purposes, for example.

The update device 100 has a detection unit 119, a control unit 102 and a communication unit 115 with an antenna 116.

The data to be transmitted, which are transmitted from the control unit 102, which is in the form of a CPU, for example, to the communication unit 115, can be encrypted by means of an encryption device 114. Similarly, the received data which are transmitted from the communication unit 115 to the control unit 102, can be decrypted by the encryption unit 114.

This allows the risk of misuse to be reduced.

The control unit 102 has an input unit 112 connected to it. For the input unit 112, it is possible to make various adjustments to the update device. By way of example, the driver can use it to determine whether he requires addressing, for what area he wants this update, etc. In addition, a visual output unit in the form of a monitor 110 is provided which can be used to output routing information and queue warning information, for example.

Furthermore, this information can also be output via an audible output unit 111. The output via the audible output unit 111 has the advantage that the driver is less distracted from what is currently happening in the traffic.

A memory element 113, which is connected to the control unit 102 or is integrated in the control unit 102, stores the digital map data (e.g. as navigation map data) in the form of data records. By way of example, the memory element 113 also stores additional information about traffic restrictions and the like in association with the data records.

In addition, a driver assistance system 117 is provided which is supplied with the digital map data.

For the purpose of determining the current vehicle position, the update device 100 has a navigation unit with a satellite navigation receiver 106 which is designed to receive navigation signals from Galileo satellites or GPS satellites, for example. Naturally, the navigation unit with the satellite navigation receiver 106 may also be designed for other satellite navigation systems.

Since the navigation signals cannot always be received in city centers, for example, the update device also has a direction sensor 107, a distance sensor 108, a steering wheel angle sensor 109 and possibly also a spring excursion sensor 118 and also an ESP sensor system 104 and/or a visual detector 105, such as a camera, for the purpose of performing compound navigation.

The signals from the GPS receiver and from the other sensors are handled in the control unit 102. The vehicle position ascertained from said signals is aligned with the roadmaps using map matching. The routing information obtained in this manner is finally output via the monitor 110. The position statements ascertained in this manner are transmitted to the control center or to adjacent vehicles by means of the communication unit 115.

Figure 2:
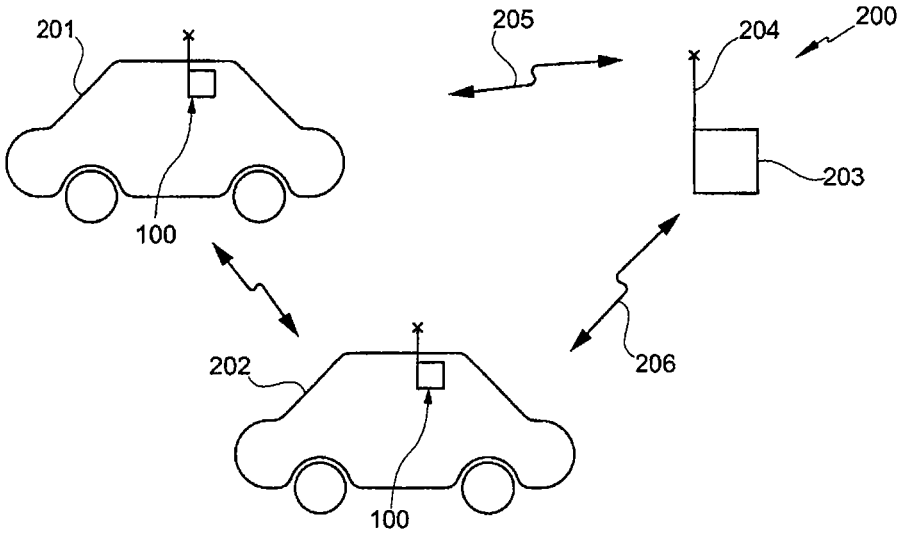
FIG. 2 shows a schematic illustration of an update system based on an exemplary embodiment of the invention.

FIG. 2 shows a schematic illustration of an update system based on an exemplary embodiment of the invention which has a plurality of vehicles 201, 202 with appropriate update devices 100 and also a control center 200.

The control center 200 comprises a communication unit 203 in the form of a central server and an antenna 204 for sending and receiving the data and information using the radio transmission link 205, 206.

The control center 200 is a static control center which can choose the update data fully automatically.

Each of the vehicles 201, 202 contains an update device 100. The communication units linked thereto can be used by the update devices 100 to communicate with one another and with the control center and to interchange position data, other measurement data, and also update data.

The end of the queue is identified using floating car data. This involves all the equipped vehicles sending their position to the central computer 203. When this computer 203 identifies a queue or when a vehicle itself identifies the queue, the position of the last vehicle in the queue is recorded as the end of the queue and is transmitted to the digital maps in the vehicles using the update mechanism. In this context, the course of the end of the queue can sometimes also be detected, if this is possible.

Figure 3:
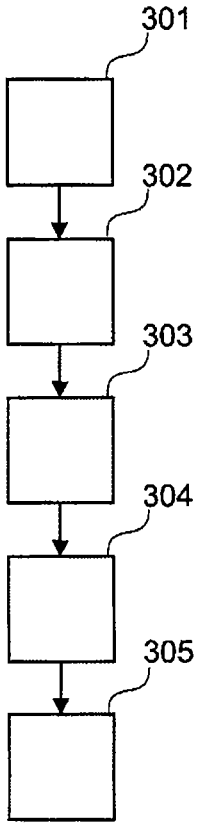
FIG. 3 shows a flowchart for a method based on an exemplary embodiment of the invention.

FIG. 3 shows a flowchart for a method in which a vehicle ascertains its position in step 301. This position is then sent to the control center in step 302, said control center then analyzing the position statement (taking account of a history, that is to say earlier transmitted position statements) and/or taking account of position statements from further vehicles in step 303. In step 304, these update data, which contain a queue warning, are transmitted to the other relevant vehicles. The vehicles then update their digital maps in step 305.

In this way, it is possible for digital navigation data to be updated in a personalized manner, that is to say in a manner adapted to suit the current situation of the vehicle, for example.

In line with one aspect of the invention, digital maps are used with an update mechanism. This update mechanism is used to transmit the position of the end of the queue. The position of the end of the queue is identified using floating car data. In addition, it is possible to predict the position of the end of the queue using floating car data.

In addition, it should be pointed out that "comprising" and "having" do not exclude other elements or steps, and "a" or "an" does not exclude a large number. Furthermore, it should be pointed out that features or steps which have been described with reference to one of the above exemplary embodiments can also be used in combination with other features or steps from other exemplary embodiments described above.

The invention claimed is:

1. An update device for a vehicle for updating a digital map for a purpose of providing a queue warning, said update device comprising:

a detection unit for ascertaining a position of the vehicle on a roadway;

a communication unit for transmitting the position of the vehicle to other vehicles on the roadway and for receiving respective positions of the other vehicles, the other vehicles including a plurality of vehicles adjacent to the vehicle on the roadway; and a control unit for:

determining, at any position on the roadway, a queue by comparing the position of the vehicle relative to positions of the plurality of adjacent vehicles on the roadway, by:

setting the vehicle as a first dynamic reference point at a start of the queue in response to the comparison indicating that the vehicle is in front of the plurality of adjacent vehicles, setting the vehicle as a second dynamic reference point at an end of the queue in response to the comparison indicating that the vehicle is in back of the plurality of adjacent vehicles, and determining that the vehicle is in the queue in response to the comparison indicating that the vehicle is in between at least two of the plurality of adjacent vehicles, updating the digital map, including navigation information for the vehicle, to show the position of the vehicle at the end of the queue, and providing a queue warning to the other vehicles on the roadway identifying the last vehicle in the queue as being the end of the queue.

2. The update device as claimed in claim 1, wherein the communication unit is configured to receive update data from a third vehicle, wherein the update data are based on an ascertained position for an end of the queue; and wherein the digital map is updated on the basis of the update data to show the position of the vehicle at the end of the queue.

3. The update device as claimed in claim 1, wherein a position of the vehicle at the end of the queue is ascertained on the basis of floating car data.

4. The update device as claimed in claim 1, wherein a position of the vehicle at the end of the queue is ascertained in real time.

5. An update system for updating a digital map in a vehicle for a purpose of providing a queue warning, said update system comprising:

an update device as claimed in claim 1;

a control center for creating the update data for the digital map on the basis of a transmitted positions of the vehicle and the adjacent vehicles.

6. The update system as claimed in claim 5, wherein the control center is configured to ascertain a position of an end of the queue.

7. The update system as claimed in claim 5, wherein the control center is configured to trigger an update for the digital map.

8. The update system as claimed in claim 5, wherein the control center is configured to transmit the update data to selected ones of the vehicle and the adjacent vehicles.

9. The update system as claimed in claim 5, wherein the update system is configured to predict a queue on the basis of a transmitted position of the vehicle and transmitted positions from other vehicles.

10. The use of an update device as claimed in claim 1 in a vehicle.

11. A method for updating a digital map for a vehicle for a purpose of providing a queue warning, said method comprising the following steps:

ascertaining a position of the vehicle on a roadway;

transmitting the position of the vehicle to other vehicles on the roadway;

receiving positions of the other vehicles on the roadway including the positions of a plurality of vehicles adjacent to the vehicle;

creating update data for the digital map on the basis of the transmitted position of the vehicle and the received positions of the plurality of adjacent vehicles;

transmitting the update data to another vehicle;

determining, at any position on the roadway, a queue by comparing the position of the vehicle relative to positions of the plurality of adjacent vehicles on the roadway, by:

setting the vehicle as a first dynamic reference point at a start of the queue in response to the comparison indicating that the vehicle is in front of the plurality of adjacent vehicles, setting the vehicle as a second dynamic reference point at an end of the queue in response to the comparison indicating that the vehicle is in back of the plurality of adjacent vehicles, and determining that the vehicle is in the queue in response to the comparison indicating that the vehicle is in between at least two of the plurality of adjacent vehicles;

updating the digital map, including navigation information for the vehicle, to show the position of the vehicle at the end of the queue; and providing a queue warning to the other vehicles on the roadway identifying the last vehicle in the queue as being the end of the queue.

12. A non-transitory computer-readable medium which stores a computer program product which, when executed on the processor, instructs the processor to perform the following steps:

ascertaining a position for the vehicle on a roadway;

transmitting the position of the vehicle to other vehicles on the roadway;

receiving update data from one of the other vehicles on the roadway, the update data having been created on the basis of the position transmitted by the vehicle and positions transmitted by the other vehicles on the roadway including a plurality of vehicles having positions adjacent to the position of the vehicle;

determining, at any position on the roadway, a queue by comparing the position of the vehicle relative to positions of the plurality of adjacent vehicles on the roadway, by:

setting the vehicle as a first dynamic reference point at a start of the queue in response to the comparison indicating that the vehicle is in front of the plurality of adjacent vehicles, setting the vehicle as a second dynamic reference point at an end of the queue in response to the comparison indicating that the vehicle is in back of the plurality of adjacent vehicles, and determining that the vehicle is in the queue in response to the comparison indicating that the vehicle is in between at least two of the plurality of adjacent vehicles;

updating the digital map, including navigation information for the vehicle, to show the position of the vehicle at the end of the queue; and providing a queue warning to the other vehicles on the roadway identifying the last vehicle in the queue as being the end of the queue.

13. The update device of claim 1 further comprising an audible output unit controlled by the control unit to emit an audible alarm when the position of the vehicle corresponds to the second dynamic reference point at the end of the queue.

14. The method of claim 11 further comprising emitting an audible alarm in the vehicle when the position of the vehicle corresponds to the second dynamic reference point at the end of the queue.

15. The update device of claim 1 wherein the communication unit is configured to encrypt the position of the vehicle prior to transmitting the position to the other vehicles and is configured to decrypt the respective positions received from the other vehicles.

16. The method of claim 11 further comprising:

encrypting the position of the vehicle before transmitting the position of the vehicle to the other vehicles; and decrypting the positions of the other vehicles after receiving the positions of the other vehicles on the roadway.

* * * * *